US008297289B2

(12) United States Patent
Cruz

(10) Patent No.: US 8,297,289 B2
(45) Date of Patent: Oct. 30, 2012

(54) HAIR ACCESSORY FOR INFANTS AND BABIES INCLUDING HEADBAND AND ARTIFICIAL HAIR

(75) Inventor: Melanie Alaine Cruz, Bakersfield, CA (US)

(73) Assignee: Aderans Hair Goods, Beverly Hills, CA (US)

( * ) Notice: Subject to any disclaimer, the term of this patent is extended or adjusted under 35 U.S.C. 154(b) by 50 days.

(21) Appl. No.: 12/825,289

(22) Filed: Jun. 28, 2010

(65) Prior Publication Data

US 2011/0315155 A1 Dec. 29, 2011

(51) Int. Cl.
*A45D 8/12* (2006.01)
*A45D 3/00* (2006.01)
*A42B 1/04* (2006.01)

(52) U.S. Cl. ..... 132/275; 2/171; 132/53

(58) Field of Classification Search ..... 132/275, 132/273, 53, 201, 54–56; 2/174, 207
See application file for complete search history.

(56) References Cited

U.S. PATENT DOCUMENTS

| | | | | |
|---|---|---|---|---|
| 1,525,051 | A * | 2/1925 | Smith | 132/145 |
| 1,713,616 | A * | 5/1929 | Oppenheim | 132/53 |
| 2,889,557 | A * | 6/1959 | Blair | 2/174 |
| 4,819,671 | A * | 4/1989 | Walker | 132/54 |
| 4,936,699 | A * | 6/1990 | Yoshida | 401/48 |
| 4,993,080 | A * | 2/1991 | Doty | 2/181 |
| 5,337,763 | A * | 8/1994 | Haber et al. | 132/54 |
| 5,890,498 | A * | 4/1999 | Kawaguchi | 132/275 |
| 6,237,611 | B1 * | 5/2001 | LeCrone et al. | 132/275 |
| 2006/0194050 | A1 * | 8/2006 | Van Rooy | 428/375 |

* cited by examiner

*Primary Examiner* — Robyn Doan
(74) *Attorney, Agent, or Firm* — Shumaker, Loop & Kendrick, LLP

(57) ABSTRACT

The present invention provides a hair accessory, comprising an infant or baby headband, artificial hair attached to the headband, and one or more ribbons attached to the headband or the artificial hair. In some embodiments, the artificial hair comprises ponytails or pigtails attached to the headband to provide the illusion of real ponytails or pigtails.

2 Claims, 3 Drawing Sheets

HAIR ACCESSORY FOR INFANTS AND BABIES INCLUDING HEADBAND AND ARTIFICIAL HAIR

TECHNICAL FIELD

The present invention relates generally to hair accessories for infants and babies, and more particularly, some embodiments relate to a hair accessory including a headband and hair.

DESCRIPTION OF THE RELATED ART

Weaving is the process of adding artificial human or synthetic hair to the native hair of a person. Wigs and toupees of artificial human or synthetic hair have been manufactured and used for centuries for various reasons, e.g., to enhance the appearance of the wearer, to cover flaws or imperfections in the natural or native hair of the wearer, to indicate profession, rank, or social status, etc. Most such additions to the natural hair of the wearer result in an artificial appearance, or at least are unsatisfactory in some manner. More recently, the application of relatively smaller hairpieces and extensions has been developed. Such smaller hair extensions are often more satisfactory for the wearer, as they can be more permanently attached to the scalp or native hair of the wearer, and in some cases can be treated and cared for in the same manner as the natural or native hair of the person wearing the hair extension.

A number of different types of hair extensions and application or attachment techniques have been developed over the years, but the basic types of hair extensions may be broadly divided into two categories, loose hair strands which are not attached to one another, and wefted hair extensions in which the hair strands are bound or welled together along a common line or edge, with the hair extending from this well or binding. These two different types of hair extensions may be further divided by their method of attachment to the native hair of the wearer. A large number of different attachment or application principles or techniques have been developed over the years, ranging from mechanical attachment (clamps, clips, etc.) to adhesives (chemical or heat setting, etc.) to braiding, weaving, sewing, tying, and/or knotting the hair extension into the hair of the wearer.

Each of the above types of hair extensions and methods of attachment to the head or hair of the wearer, have various disadvantages. In the case of loose, unwefted hair, the attachment process is extremely tedious and time consuming, and is thus relatively costly to perform. The result can be a beautiful and natural appearing hairdo if the hairdresser is talented, with the supplemental hair extension capable of being treated as natural hair and remaining in place for weeks.

BRIEF SUMMARY OF EMBODIMENTS OF THE INVENTION

This document describes hair accessories for infants and/or babies. In particular, the hair accessory includes an infant or baby headband with artificial hair. The artificial hair may comprise, for example, ponytails or pigtails attached to the headband to provide the illusion that the infant or baby possesses real ponytails or pigtails.

In one implementation, the hair accessory comprises an infant or baby headband, artificial hair attached to the headband, and one or more ribbons attached to the headband or the artificial hair. The artificial hair may comprise ponytails or pigtails attached to the headband to provide the illusion of real ponytails or pigtails, wherein each ponytail or pigtail includes a ribbon provided at a base of each ponytail or pigtail. The headband may be an elastic headband or a substantially inelastic headband.

In some embodiments, the artificial the hair is rolled into a ponytail or pigtail, and then fixedly attached to the headband. For example, the artificial hair may be glued, sewn, or taped to the headband. The artificial hair may comprise real human hair or synthetic fiber hair, such as comprising a monofilament fiber, a kanekalon fiber, or a toyakalon fiber. The artificial hair may be curly hair, straight hair, spiky hair, curved hair, braided hair, twist hair, wavy hair, or glitter hair.

In various implementations, the artificial hair is sewn or hot glued onto the headband such that the hair stands up with respect to the headband, wherein the artificial hair is oriented substantially perpendicular to the headband. The ribbons may be hot glued around the hair or sewn onto the headband. The artificial hair may be fashioned in a hair configuration selected from the group consisting of: a single ponytail, a single pigtail, a pair of ponytails, and a pair of pigtails.

In certain embodiments, the hair accessory may further comprise a lace trim or a boa trim. In addition, the ribbon may comprise grosgrain, satin, tulle, or glitter ribbon. The hair accessory may further comprise an embellishment attached to the headband selected form the group consisting of: flowers, rhinestones, beads, sparkle pieces, tinsel, clear and iridescent fibers, and glitter. In some embodiments, a logo is disposed on each ribbon.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF HE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward hair accessories. In some embodiments, the hair accessory includes an infant or baby headband with artificial hair. The artificial hair may comprise, for example, ponytails or pigtails attached to the headband to provide the illusion that the infant or baby possesses real ponytails or pigtails. In one implementation of the invention, the headband with ponytails or pigtails also features ribbons such that each "tail" includes a ribbon, or only one tail includes a ribbon. The headband may comprise, for example, a conventional stretch headband, per se known in the fashion arts. Other headbands of the invention may be non-stretchable.

Figure 1:
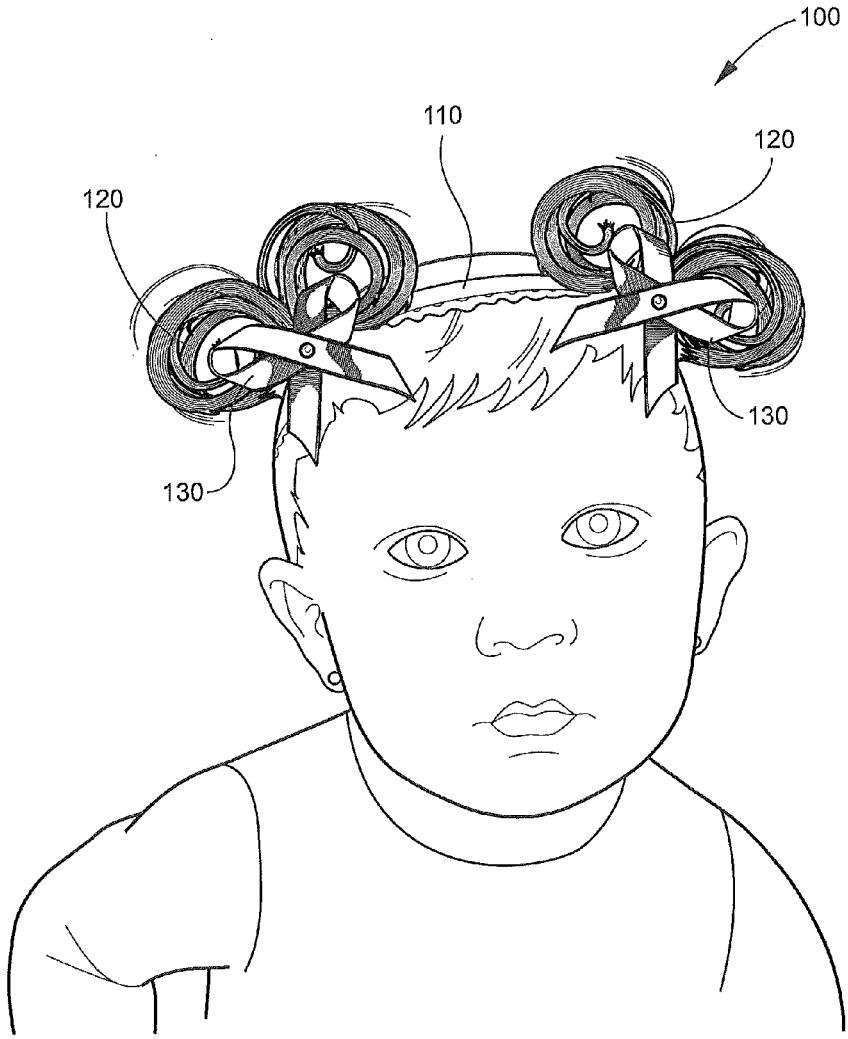
FIG. 1 illustrates a hair accessory including a headband with artificial hair in the form of a pair of ponytails or pigtails, in accordance with an embodiment of the invention.
Figure 2:
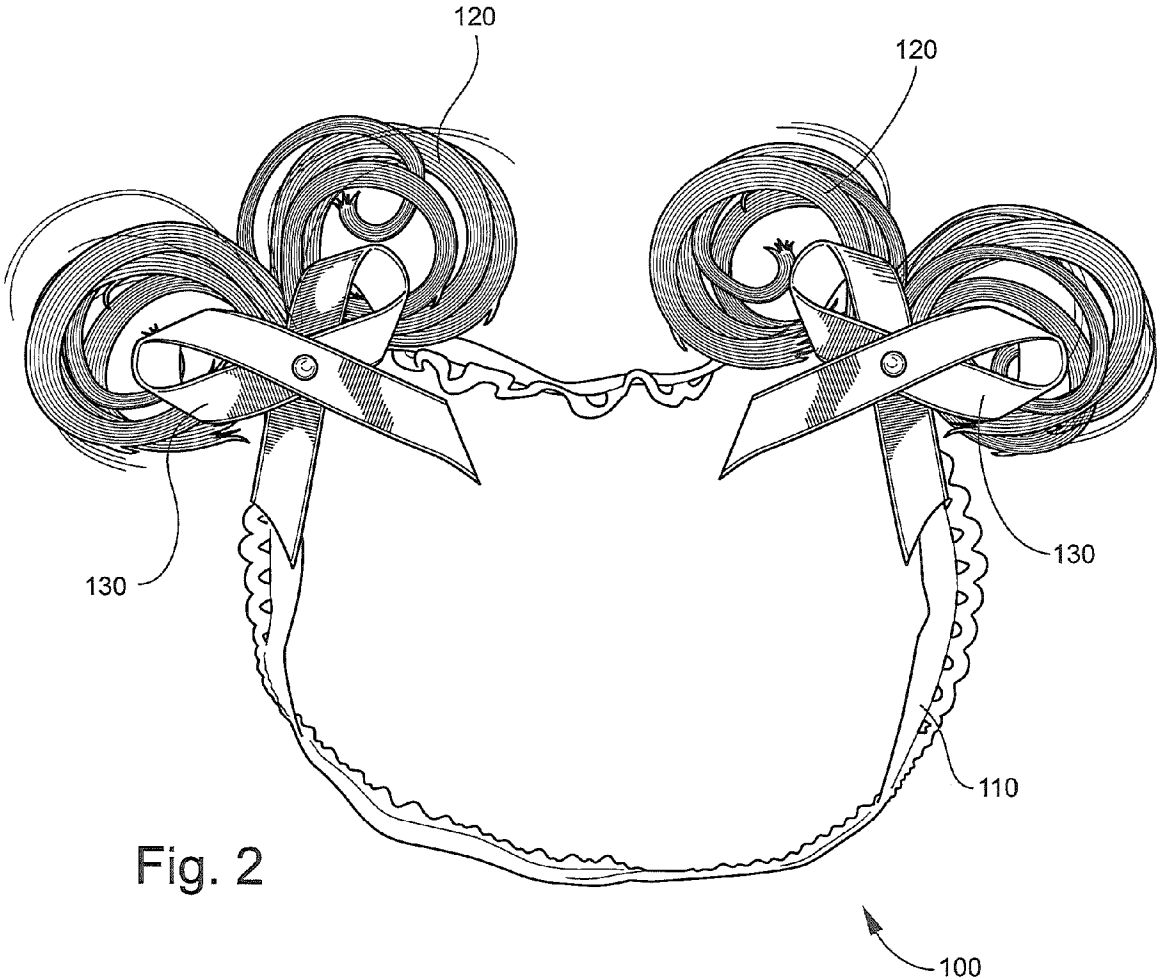
FIG. 2 is a front elevation of the hair accessory as shown in FIG. 1.
Figure 3:
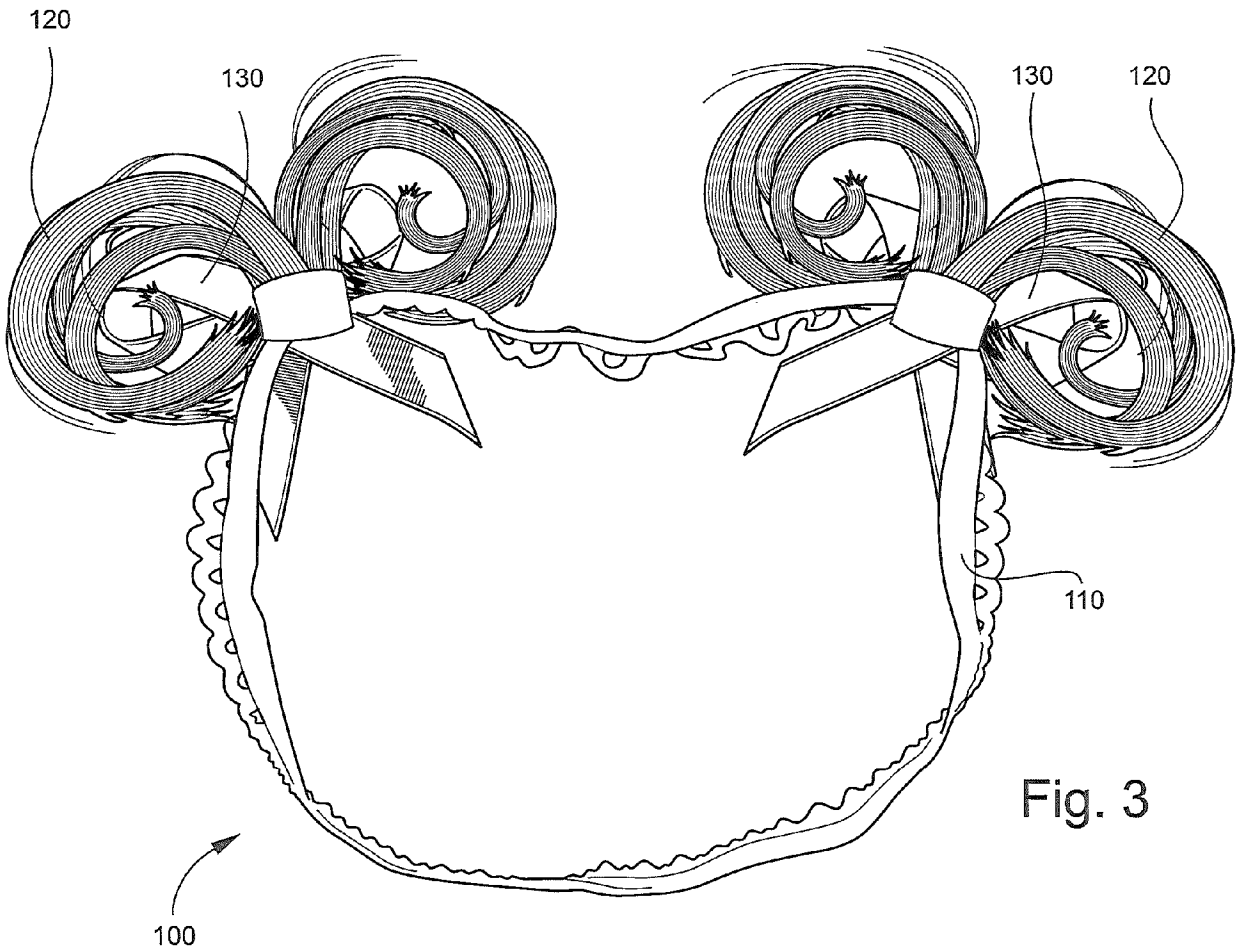
FIG. 3 is an elevation of the hair accessory as shown in FIG. 1 and showing the reverse side.

Referring to FIG. 1, a hair accessory 100 comprising an infant's (or baby's) headband 110 with artificial hair 120 in the form of a pair of ponytails 120 or pigtails 120 is provided in accordance with an embodiment of the invention. The artificial hair 120 provides the illusion that the infant or baby possesses real ponytails or pigtails. A ribbon 130 is provided at the base of each ponytail 120 or pigtail 120. Before being affixed to the headband 110, the hair is rolled into a ponytail 120 or pigtail 120, and then glued, sewn, taped, or otherwise attached to the headband 120.

The hair accessory 100 may feature real human hair and/or synthetic fiber hair. By way of example, the synthetic fiber hair may comprise a monofilament fiber, a kanekalon fiber, toyakalon fiber, and/or any other conventional synthetic hair fiber. The real or synthetic hair 120 may be fashioned as curly hair, straight hair, spiky hair, curved hair, braided hair, twist hair, wavy hair, and glitter hair.

In some embodiments, the real or synthetic hair 120 is sewn and/or hot glued onto the headband 110 such that the hair 120 stands up properly with respect to the headband 110 and the infant's (or baby's) natural hair. In particular, in ponytail or pigtail embodiments, the tails 120 are substantially oriented perpendicular with respect to the headband 110 and the wearer's head, as depicted in FIG. 1. In such embodiments, the ribbons 130 are hot glued around the hair 120 and/or sewn onto the headband 110. Prior to being attached to the headband 110, the hair 120 is first rolled, and then glued to the headband 110 such that the hair 120 stands up and appears to be an extension of the natural hair.

In various embodiments of the invention, the hair accessory 100 includes an infant or baby headband 110 with artificial hair 120, wherein the hair 120 is fashioned in any hair configuration, including but not limited to: (i) a single ponytail, (ii) a single pigtail, (iii) a pair of ponytails, (iv) a pair of pigtails, or (v) three or more ponytails or pigtails.

The hair accessories disclosed herein may feature bows and/or ribbons such that each tail includes a bow or ribbon, or only one tail includes a bow or ribbon. In some embodiments, the hair accessory includes a Korker bow for each tail. In addition, some embodiments also include lace trims, boa trims, any type of stretch lace and elastics, and any other conventional trims. The ribbon may be of any size and shape, and may comprise grosgrain, satin, tulle, glitter ribbon, or any other ribbon fabric.

Various hair accessory embodiments of the invention may also include embellishments, such as including, but not limited to: (i) flowers, (ii) rhinestones, (iii) beads, (iv) sparkle pieces, (v) tinsel, (vi) clear and iridescent fibers, (vii) glitter, and/or (viii) all other known hair embellishments of any shape or size.

Some embodiments of the invention may feature hair accessories including logos. For example, a hair accessory may feature team logo ribbons for a particular sponsor or licensee. In further embodiments, the headband may also feature various logos.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more, least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. These illustrations and their accompanying description should not be construed as mandating a particular architecture or configuration.

The invention claimed is:

1. A hair accessory, comprising:

(a) A decorative elastic band adapted for being positioned and encircling the head of a wearer in an orientation from the lower rear of the head, the rear of the ears and across the top of the head;

(b) first and second hair elements in the form of multiple curls attached to the elastic band in spaced-apart relation to each other, positioned to reside on top of the head in an area outboard of the eyes and inboard of the ears of the wearer; and extending upwardly from the elastic band and the head:

(c) first and second decorative elements in the form of ribbons attached to the elastic band at respective positions where the hair elements are attached to the elastic band, wherein the first and second decorative elements each comprise a ribbon that is folded on itself to form first and second loops and first and second tag ends, the ribbon being held in its folded position by a decorative fastener at a position where the ribbons cross.

2. A hair accessory according to claim 1, wherein the hair elements comprise a plurality of curls that extend upwardly and outwardly from the elastic band in opposite directions.

* * * * *